United States Patent [19]

Haugsjaa et al.

[11] 3,993,927

[45] Nov. 23, 1976

[54] ELECTRODELESS LIGHT SOURCE

[75] Inventors: Paul Osborne Haugsjaa, Acton; Robert James Regan, Needham; William Henry McNeill, Carlisle, all of Mass.

[73] Assignee: GTE Laboratories Incorporated, Waltham, Mass.

[22] Filed: Apr. 21, 1975

[21] Appl. No.: 570,112

[52] U.S. Cl. ..... 315/39; 315/55; 315/150; 315/248; 315/267

[51] Int. Cl.[2] ..... H05B 41/24

[58] Field of Search ..... 315/55, 150, 39, 248, 315/267; 313/100

[56] References Cited

UNITED STATES PATENTS

| | | | |
|---|---|---|---|
| 3,787,705 | 1/1974 | Bolin | 315/267 |
| 3,790,852 | 2/1974 | Bolin | 315/267 |
| 3,826,950 | 7/1974 | Hruda | 315/267 |

OTHER PUBLICATIONS

Rev. of Sci. Instr. "Microwave Discharge Cavities Operating at 2450MHZ, F. C." Fehsenfeld et al., vol. 36, No. 3, Mar. 1965.

*Primary Examiner*—John Kominski

*Attorney, Agent, or Firm*—Irving M. Kriegsman; Leslie J. Hart

[57] ABSTRACT

A termination fixture for an electrodeless lamp has dimensions which match the output impedance of a coupled high frequency power source to the real impedance of the lamp when in a discharge condition. The fixture may consist of a pair of coaxial conductors, and the lamp forms the termination load for the ends of the conductors. The length of the conductors is such as to place the lamp one quarter wavelength from the opposite ends of the conductors. The diameters of the conductors are such as to produce a fixture characteristic impedance which matches the lamp impedance to the source output impedance.

2 Claims, 3 Drawing Figures

ELECTRODELESS LIGHT SOURCE

CROSS REFERENCE TO REALTED APPLICAION

This application is related to U.S. Pat. application, Ser. No. 570,113 filed concurrently in the names of P. Haugsjaa and R. Regan and assigned to the same assignee of the present patent application.

BACKGROUND OF THE INVENTION

The present invention relates to electrodeless light sources and, more particularly, to such sources which are excited by high frequency power, such as in the range of 100 MHz to 300 GHz.

There have been, historically, three basic methods of exciting discharges without electrodes. The first method uses the discharge as a lossy part of either the capacitance or inductance of a "tank" circuit. This method is used to advantage only at frequencies where the dimensions of the lamp are much smaller than the wavelength of excitation. Also, in this method, there are power losses due to radiation and shifts in frequency upon start-up. A second method of exciting electrodeless lamps with microwave power is to place the lamp in the path of radiation from a directional antenna. However, since free propagation of microwave power occurs, there is an inherent inefficiency and some of the power is scattered thereby endangering persons in the area.

A third method uses a resonant cavity which contains the lamp, a frequency tuning stub and a device for matching the lamp-cavity impedance to that of the source and transmission line. Examples of devices according to this method may be found in "Microwave Discharge Cavities Operating at 2450 MHz" by F. C. Fehsenfeld et al., Review of Scientific Instruments, Volume 36, Number 3, (March, 1965). This publication describes several types of tunable cavities. In one type, cavity No. 5, the discharge cavity transfers power from the source to the lamp, and the resonant structure of the cavity increases the electric field in the gas of the lamp. The presence of a discharge in the resonator changes the resonant frequency and also changes the loaded Q factor. Therefore, it is necessary to provide both tuning (frequency) and mathcing (impedance) adjustments to obtain efficient operation over a wide range of discharge conditions. The tuning stub is first adjusted for a minimum reflected power with the minimum probe penetration. Next, the probe (impedance) is adjusted. Since these two operations are not independent, successive readjustments are required to achieve optimum efficiency.

All of these tunable cavities have features which make them less than ideally suited for use in an electrodeless light source. To make cavity type systems useful economically, the cavity must be small enough so that it would be feasible to use such systems in place of the conventional electrode-containing lamp. Resonant cavities are too large and must be larger if lower microwave frequencies are used. One resonant cavity for 2450 MHz operation has four inches as its greatest dimension; the size would be even larger for operation at 915 MHz which is a standard microwave frequency for consumer use, such as with microwave ovens. Operation at this lower frequency is also advantageous from the view that the greater the frequency, the more expensive the microwave power source becomes. The known tunable cavity has a less than optimum shape because the lamp is substantially enclosed by the resonant cavity housing, thereby impeding the transmission of light.

SUMMARY OF THE INVENTION

According to the present invention, a light source includes an electrodeless discharge lamp and a fixture coupled to a source of high frequency power. The fixture includes a inner conductor and an outer conductor disposed around the inner conductor, the lamp being located in the high field region at the ends of the conductors to form a termination load for the high frequency power applied to the other ends of the conductors. The fixture conductors have dimensions effective to produce a characteristic impedance which matches the real impedance of a lamp which is already in a discharge condition to the output impedance of the high frequency power source. As a result of this impedance match, essentially all of the high frequency power is transmitted to the electrodeless discharge. This feature permits the use of a termination fixture which does not require either external or internal impedance matching for exciting an electrodeless lamp.

In a preferred feature of the invention, the length of the conductors is such as to place the lamp one quarter wavelength away from the conductor ends which are coupled to the source and the ratio of the cross-sectional dimensions of the conductors is chosen so as to produce a characteristic impedance which is equal to the square root of the product of the real part of the lamp impedance and the coupled source impedance.

In another feature, if the lamp impedance is greater than the source impedance, the fixture characteristic impedance must be greater than the source impedance. This feature provides an increase in available lamp starting voltage over that provided at start-up in a fixture which has a characteristic impedance equal to the source impedance.

DESCRIPTION OF PREFERRED EMBODIMENTS

Figure 1:
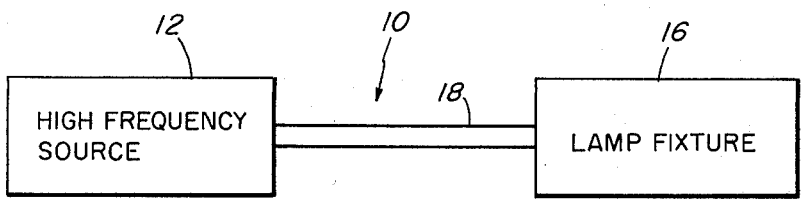
FIG. 1 is a block diagram of the improved electrodeless light source according to the present invention.
Figure 2:
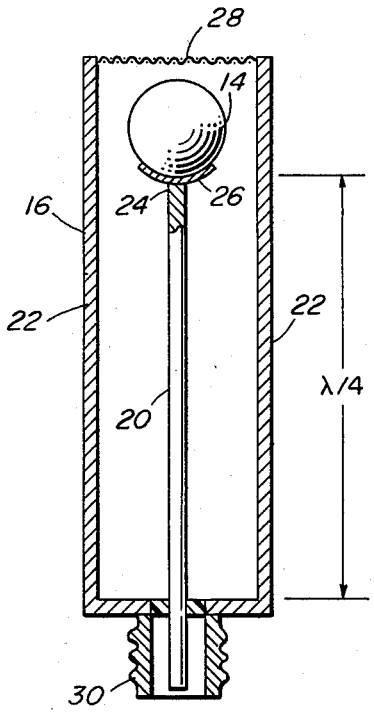
FIG. 2 is a sectional view of a preferred embodiment for a lamp fixture according to the present invention.

In an exemplary embodiment of the present invention, as illustrated in FIGS. 1 and 2, a light source, indicated generally by the reference numeral 10, includes a source 12 of power at a high frequency, an electrodeless lamp 14 and a termination fixture 16 which is coupled to the source 12. As used herein, the phrase "high frequency" is intended to include frequencies in the range from 100 MHz to 300 GHz. Preferably, the frequency is in the ISM band (i.e., industrial, scientific and medical band) which ranges from 902 MHz to 928 MHz. In the embodiment of FIG. 2 the frequency used was 915 MHz. One of many commerically available power sources which may be used is an Airborne Instruments Laboratory Power Signal Source, type 125. The lamp 14 has an envelope made of a light transmitting substance, such as quartz. The envelope encloses a volatile fill material which produces a light emitting discharge upon excitation. The following are specific examples of lamps and fill materials which may be used.

EXAMPLE I

| | |
|---|---|
| Fill Material | 9.1 mg. of mercury<br>10 torr of argon |
| Envelope | Quartz sphere having a 15 mm. ID |

EXAMPLE II

| | |
|---|---|
| Fill Material | 8.9 mg. of mercury<br>1.5 mg. of $ScI_3$<br>1.7 mg. NaI<br>20 torr of argon |
| Envelope | Quartz sphere having a 15 mm. ID |

EXAMPLE III

Another fill material is 2 or 3 atoms of sodium for each mercury atom to yield under operating conditions 200 torr sodium partial pressure and about 1,000 torr mercury partial pressure. The envelope is a material which is resistant to sodium such as translucent $Al_2O_3$.

According to the present invention, the termination fixture 16 is coupled to the source 12 by any suitable medium, such as with a cable 18. The fixture has an inner conductor 20 and an outer conductor 22 around the inner conductor. In FIG. 2, the conductors have a circular cross-section and are located concentrically with respect to each other. The inner conductor 20 has an end 24 which is in contact with the lamp 14. Preferably, the end 24 has affixed thereto a lamp seating element 26. A screen 28 may be located across the opening of the outer conductor 22. Power is coupled to the conductors via a connector 30.

In accordance with the present invention, the conductors 20 and 22 have dimensions effective to produce a characteristic impedance which matches the real impedance of the lamp in a discharge condition to the impedance of the coupled high frequency source. Such a condition substantially eliminates the reflection of high frequency power from the fixture when the lamp is in the discharge condition.

One technique for this impedance matching is to make the length of the conductors such as to place the lamp one quarter wavelength away from the conductor ends which are coupled to the source and to make the characteristic impedance of the fixture equal to $\sqrt{Z_S \cdot R_L}$, where $Z_S$ is the source impedance and $R_L$ is the real part of the lamp impedance in the discharge state.

For the FIG. 2 embodiment, the cross-sectional shape of the conductors 20 and 22 are circular and the characteristic impedance is a function of the ratio of the conductor diameters by the following equation.

$$Z = \frac{138}{\log \sqrt{\epsilon_r/\mu_r}} \quad \frac{b}{a}$$

where $\epsilon_r$ = dielectric constant of the medium between the conductors $\mu_r$ = permeability of the medium between the conductors $b$ = inner diameter of the outer conductor $a$ = diameter of the inner conductor.

In another feature of the embodiment illustrated in FIG. 2, the inner diameter of the outer conductor 22 is greater than the greatest dimension of the lamp 14 in a direction transverse to the longitudinal axis. This feature permits the outer conductor 22 to serve as an enclosure or housing for the lamp 14.

For many applications, the impedance of the lamp is higher than that of the power source or the characteristic impedance of the transmission line 18. This means that the impedance of the matching section must be greater than the output impedance of the source 12. This is advantageous because the higher impedance of the matching section; i.e., the quarter wave fixture imposes a larger voltage across the open circuit prior to lamp breakdown than is imposed with a termination fixture whose characteristic impedance is equal to that of the source. For exmple, if the source and/or transmission line characteristic impedance is 50 ohms, the characteristic impedance of the quarter wave fixture will be $50 \times \sqrt{f}$ ohms, where $f$ is a number greater than 1 equal to the ratio of the load impedance of the running lamp to the source impedance. Whereas, in a 50 ohm termination fixture, the initial voltage is twice the incident voltage from the source; in the quarter wave fixture above described the initial voltage is $2. \sqrt{f}$ times the incident voltage. This higher voltage enables faster, more reliable staring. Thus, the quarter wave termination fixture 16 has the advantage of eliminating the need for an external matching network, reducing loss of microwave power due to large standing waves between the lamp 14 and an external matching network and providing better starting characteristics.

Figure 3:
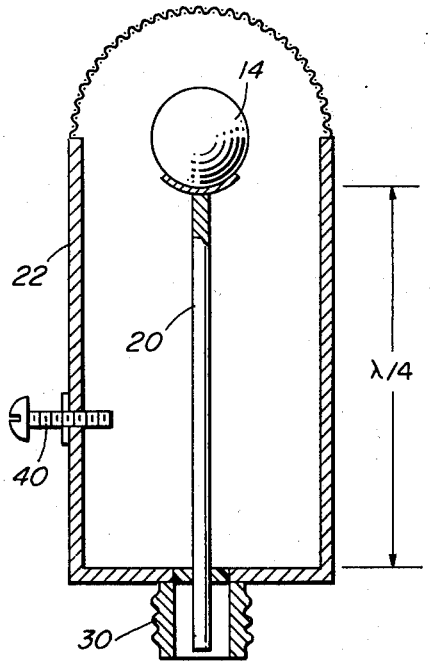
FIG. 3 is a sectional view of an alternative embodiment of a fixture which includes a fine tuning device.

FIG. 3 shows an alternative embodiment in which a fine tuning device, such as a tuning screw 40 may be utilized in the fixture 16 for fine tuning the fixture impedance to provide a perfect match. Also, for even greater starting reliability, a starting assist device, such as UV source (not shown) may be used.

The following illustrates some of the preferred dimensional features of the termination fixture 16 and preferred lamp compositions for providing a light source having potential for use in consumer applications. At a frequency of 915 MHz, the quarter wave fixture 16 has a length of about 8.13 cm. The magnitude of the diameter of the outer conductor 22 is aproximately 2.54 cm. The lamp 14 which was used in the fixture having these dimensions has an envelope having a 1 cm. diameter and being made spherically shaped and of a quartz material. The fill material within this envelope includes approximaterly 0.3 $\mu$1 of mercury and 10 torr argon. This lamp has a measured impedance in the discharge condition of approximately 450 ohms. Since for this impedance $f = 9$, the impedance of the quarter wave fixture 16 is 150 ohms. For a 2.54 cm. diameter outer conductor, the inner conductor 20 diameter is 0.21 cm. In operation, upon the application of power at 915 MHz from the source 12, the lamp initiated discharge in a glow mode. As the mercury pressure grew, the reflected power dropped quickly. After a few seconds, the glow discharge went over to an arc. In the arc mode, the quarter wavelength fixture produced sufficient impedance matching to substantially eliminate power reflected from the lamp to source. Thus, with a fixture such as shown in FIG. 2 having about a 3 inch length and a 1 inch overall diameter, a lamp can be started and brought to maximum efficiency without need for external tuning.

The embodiments of the present invention are intended to be merely exemplary and those skilled in the art shall be able to make numerous variations and modifications to them without departing from the spirit of the present invention. All such variations and modifications are intended to be within the scope of the prsent invention as defined in the appended claims.

We claim:

1. A light source including:

a. a source of power at a high frequency, b. an electrodeless lamp having an envelope made of a light transmitting substance, the envelop enclosing a votaile fill material which produces a light emitting discharge upon excitation, and c. a termination fixture coupled to the source, the fixture having an inner conductor and an outer conductor disposed around the inner conductor, the lamp being coupled across the end of the conductors to form the termination for the conductors, the conductors of the fixture having dimensions effective to produce a characteristic impedance which matches the real impedance of the lamp in a discharge condition to the impedance of the coupled high frequency source thereby substantially eliminating the reflection of high frequency power from the fixture when the lamp is in the discharge condition, the length of the conductors being such as to place the lamp one quarter wavelength away from the conductor ends which are coupled to the source and the characteristic impedance of the fixture being equal to $\sqrt{Z_S \cdot R_L}$, where $Z_S$ equals the output impedance of the coupled high frequency source, and $R_L$ equals the impedance of the lamp in the discharge condition.

2. The light source according to claim 1 wherein the characteristic impedance of the termination fixture is greater than the output impedance of the coupled high frequency source to create a voltage across the lamp prior to breakdown that is greater than the incident voltage from the source by a factor equal to twice the ratio of the characteristic impedance of the fixture to the output impedance of the source.

* * * * *

PO-1050
(5/69)
A114

UNITED STATES PATENT OFFICE
CERTIFICATE OF CORRECTION

Patent No. 3,993,927 Dated November 23, 1976

Inventor(s) PAUL OSBORNE HAUGSJAA, ET AL.

It is certified that error appears in the above-identified patent and that said Letters Patent are hereby corrected as shown below:

Column 1, line 45, delete "mathcing" and substitute therefor --matching--.

Column 2, line 9, delete "a" and substitute therefor --an--.

Column 3, lines 58-62, delete "

$$Z = \frac{138}{\log \sqrt{\epsilon_r/\mu_r}} \quad \frac{b}{a}$$

"

and substitute therefor $$-- Z = \frac{138}{\sqrt{\epsilon_r/\mu_r}} \log \frac{b}{a} --.$$

Column 5, line 6, delete "prsent" and substitute therefor --present--.

Column 5, line 13, delete "votaile" and substitute therefor --volatile--.

Signed and Sealed this

Eighth Day of March 1977

[SEAL]

*Attest:*

RUTH C. MASON
*Attesting Officer*

C. MARSHALL DANN
*Commissioner of Patents and Trademarks*